United States Patent [19]

Schauer

[11] 4,096,786

[45] Jun. 27, 1978

[54] ROTARY FLUID ENERGY TRANSLATING DEVICE

[75] Inventor: George A. Schauer, Ames, Iowa

[73] Assignee: Sundstrand Corporation, Rockford, Ill.

[21] Appl. No.: 798,603

[22] Filed: May 19, 1977

[51] Int. Cl.[2] ..... F01B 13/04

[52] U.S. Cl. ..... 91/499; 91/6.5

[58] Field of Search ..... 91/6.5, 486–488, 91/499, 504–507

[56] References Cited

U.S. PATENT DOCUMENTS

| | | | |
|---|---|---|---|
| 2,075,017 | 3/1937 | Benedek | 91/491 |
| 2,642,809 | 6/1953 | Born et al. | 91/6.5 |
| 2,963,983 | 12/1960 | Wiggermann | 91/6.5 |
| 3,037,489 | 6/1962 | Douglas | 91/486 |
| 3,094,078 | 6/1963 | Brueder | 91/6.5 |
| 3,157,130 | 11/1964 | Cadiou | 91/6.5 |
| 3,199,461 | 8/1965 | Wolf | 91/6.5 |
| 3,202,106 | 8/1965 | Firth et al. | 91/499 |
| 3,382,813 | 5/1968 | Schauer | 91/6.5 |
| 3,752,053 | 8/1973 | Wouters et al. | 91/485 |
| 3,858,483 | 1/1975 | Hein | 91/6.5 |

*Primary Examiner*—William L. Freeh

*Attorney, Agent, or Firm*—Wegner, Stellman, McCord, Wiles & Wood

[57] ABSTRACT

A rotary fluid energy translating device having reduced noise levels and having a rotatable cylinder block with a plurality of cylinders therein and each having a movable piston, valve means having inlet and outlet port means adapted to serially connect with the cylinders and also having a pair of cross-over areas positioned to block a cylinder from simultaneous communication with the inlet and outlet port means and with the pistons within the cylinders adjacent one cross-over area positioned to provide a small fluid volume in the associated cylinders and positioned to provide a large fluid volume in the cylinders adjacent the other cross-over area. Each cross-over area has at least one trapped fluid chamber, with a restricted flow passage positioned to communicate with a cylinder and a piston is positioned in each of the trapped fluid chambers and movable to positions to vary the volume of the chamber. Pilot lines extended to the port means and associated one with each trapped fluid chamber are operable to control the position of the pistons in the trapped fluid chambers to have a small volume chamber when an adjacent cylinder of the cylinder block has a small fluid volume and to have a large volume trapped fluid chamber when an adjacent cylinder of the cylinder block has a large fluid volume.

26 Claims, 20 Drawing Figures

L.P.
H.P.

ROTARY FLUID ENERGY TRANSLATING DEVICE

BACKGROUND OF THE INVENTION

This invention pertains to rotary fluid energy translating devices, such as a pump or motor wherein the cylinders of a rotatable cylinder block make a transition between inlet and outlet port means and, therefore, between high and low fluid pressures, and with the invention disclosed herein relating to means to reduce the noise of operation of the device by achieving an intermediate pressure in cylinders by utilization of trapped fluid volumes which are variable, dependent upon the volume of fluid in the cylinders in each area of transition.

In fluid energy translating devices of the type disclosed herein, it is characteristic that a rotatable cylinder block is associated with a valve plate having inlet and outlet port means for directing flow to and from cylinders within the cylinder block. More particularly, an axial piston unit has pistons disposed within the cylinders of the cylinder block and with the stroke of the pistons during a revolution of the cylinder block being controlled by a swash plate. There are two cross-over areas provided in the valve plate to separate the inlet and outlet port means, with the cross-over areas being of an arcuate length to prevent a single cylinder cross-connecting the inlet and outlet port means. Also in devices of this type, it is inherent that the pistons carried within the cylinders of the cylinder block progressively reach a fully-extended position at one cross-over area and a fully-retracted position at the other cross-over area. The maximum stroke to result in maximum extension and retraction would be caused by the angle of the swash plate and if the swash plate has a variable angle, the maximum extension and retraction positions of the pistons in the cross-over areas would correspondingly vary.

In an axial piston-type fluid energy translating device utilized as a pump with pistons movable within a series of axially-extending cylinders in a rotatable cylinder block, the volume of the cylinders is maximum during the cross-over from low to high pressure and minimum during the cross-over from high to low pressure because of the retracted and extended positions, respectively, of the pistons in the cylinders. In such a device used as a motor, the opposite conditions exist. In a motor, the minimum cylinder volume occurs during the cross-over from low to high pressure and maximum cylinder volume exists during the cross-over from high to low pressure, again determined by the positions of the pistons within the cylinders. Normally, a pump rotates in one direction and in an adjustable swash plate unit the pump can operate under reversed delivery conditions by reversing the swash plate position beyond neutral. A structure is disclosed herein enabling rotation of the pump in either direction. When the device is a motor, it frequently may be required to operate under either forward or reverse rotation conditions. In a hydrostatic transmission, for instance, the pump will normally rotate in one direction with the delivery thereof being reversible by positioning of the swash plate and with the motor of the transmission usually being fixed displacement by a fixed angle of the motor swash plate and with the rotative direction of the motor being reversible by reversing flow from the pump. These various changes in operating conditions involve reversals in making a transition of pressure in a cylinder at a cross-over area to an intermediate pressure toward that existing in the port toward which the cylinder block is rotating.

In all the foregoing, the amount of energy for the flow required to change the pressure of a volume of fluid in a cylinder to a desired level and more particularly to an intermediate level approaching the pressure of the port means toward which the cylinder is travelling varies in proportion to the volume involved. The rate of pressure change is dependent upon the volume of fluid involved.

It is known in the art to have a fluid energy translating device wherein a cylinder of a rotatable cylinder block in passing through a cross-over area between inlet and outlet port means communicates with a trapped volume chamber to derive an intermediate pressure prior to entering into communication with a port means toward which the cylinder block is travelling. The prior art has a trapped fluid volume which is of a fixed amount and fails to recognize the improved results derived from varying the volume of the trapped fluid dependent upon the volume of fluid carried within a cylinder during rotation of the cylinder block. This volume may vary considerably between the two cross-over areas, with the pistons at one cross-over area being extended to have minimal fluid volume within the cylinders and in the other cross-over area being retracted to have a larger fluid volume within the cylinders.

With the variable trapped volumes disclosed herein, the trapped volume that communicates with a cylinder in the cross-over area is proportional thereto and the full volume of trapped fluid is utilized when a large cylinder volume communicates therewith for a controlled rate of change and a smaller trapped volume of fluid is used when a smaller cylinder volume communicates therewith to assure that the pressure transition cannot occur too fast and, thus, avoid any problems resulting from going to zero pressure or drawing a vacuum.

SUMMARY OF THE INVENTION

A primary feature of the invention disclosed herein is to provide a fluid energy translating device, such as a pump or motor, having structure to reduce the noise level of the device during operation by pressure control within the device during the transition between high and low pressure ports of the device and, particularly, by means of employing trapped volumes of fluid to obtain intermediate pressure levels during the transition and by varying the trapped volumes for a controlled rate of pressure change dependent upon the volume of fluid in the device subject to pressure transition.

Another feature of the invention is to provide a device as described in the preceding paragraph in the form of an axial piston type pump having a movable swash plate to reverse the delivery of the pump wherein the valve plate associated with the cylinder block has a pair of cross-over areas with a trapped fluid volume chamber associated with each cross-over area and each chamber having a movable piston to vary the size of said chamber. A pair of pilot lines extend one from each of the trapped fluid chambers to one or the other of said port means whereby the position of a piston to control the size of the trapped fluid chamber is determined by the pressure existing in a port means as compared with the pressure existing in a cylinder of the cylinder block of the pump which is in communication with the trapped fluid chamber through a flow passage. The pressures in the port means being related to the pressure of the fluid volume in the cylinders, whereby the trapped fluid chamber is relatively small when a cylinder having a relatively small fluid volume communicates therewith, as caused by a pumping piston being extended, and the trapped fluid chamber has a larger volume when a cylinder having a larger fluid volume communicates therewith, as caused by a pumping piston being in a retracted position.

Still another feature of the invention is to provide an axial piston-type motor having a rotatable cylinder block with a plurality of cylinders mounting movable pistons controlled by a swash plate and with the cylinder block coacting with a valve plate having inlet port and outlet port means and with a pair of cross-over areas separating the inlet and outlet port means wherein there is at least one trapped fluid chamber in each of the cross-over areas which communicates successively with cylinders during rotation of the cylinder block and with means for varying the size of the trapped fluid chamber in each cross-over area dependent upon the volume of fluid within the cylinder communicating with the trapped fluid chamber and as determined by the position of the pistons within the cylinders at the cross-over area.

An object of the invention is to provide a fluid energy translating device as described in the foregoing features of the invention.

Another object of the invention is to provide an axial piston-type pump operable at reduced noise levels by subjecting the cylinders of the pump cylinder block to trapped fluid volumes in each cross-over area to bring the pressure in a cylinder to an intermediate level approaching that existing in the port means toward which the cylinder is travelling in rotation of the cylinder block and with the trapped fluid volumes in each cross-over area being variable dependent upon the volume of fluid within a cylinder communicating therewith in order to have a pressure transition occur through an expansion rate, dependent upon the volume of fluid in a cylinder.

Another object of the invention is to provide an axial piston-type pump, as defined in the preceding paragraph wherein the pump may also be operable in either direction of rotation of the cylinder block thereof and with the same pressure transition occurring in either direction of rotation by the provision of a pair of trapped fluid chambers in each cross-over area of the pump to have a trapped fluid chamber effective to accomplish pressure transition of the fluid in a cylinder to an intermediate pressure level approaching that existing in the port means towards which the cylinder is travelling.

Another object of the invention is to provide an axial piston-type motor having the same pressure transition features as the aforesaid axial piston-type pump.

Figures 1, 1A, 2, 3, 4, 4A, 5, 6, 7, 7A, 8, 9:
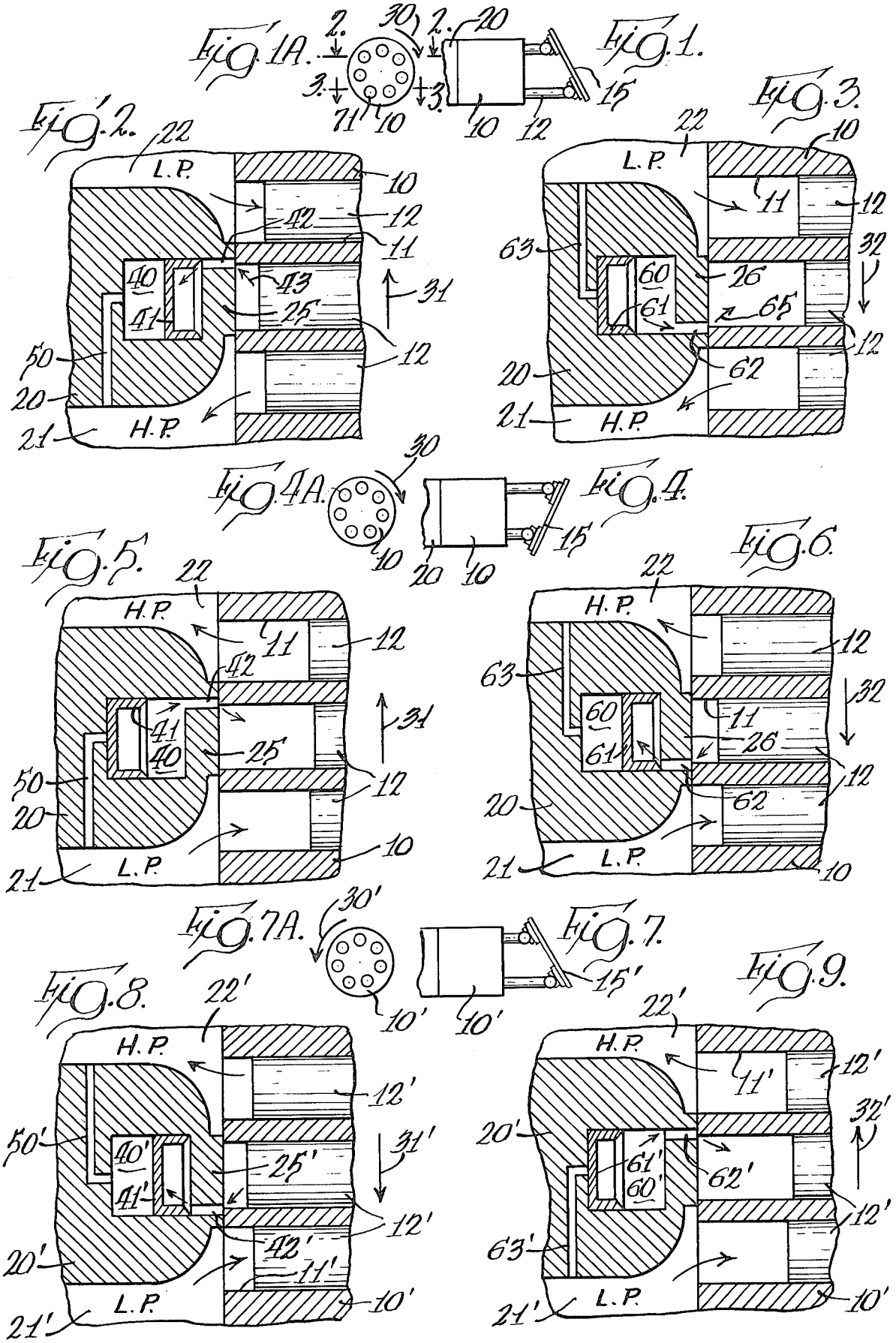
FIG. 1 is a fragmentary side elevational view of a rotary fluid energy translating device operable as a pump.
FIG. 1A is a diagrammatic view of the cylinder block of the device providing an indication of rotation to facilitate an understanding of FIGS. 2 and 3.
FIG. 2 is a sectional view, taken generally along the line 2—2 in FIG. 1A.
FIG. 3 is a view, taken generally along the line 3—3 in FIG. 1A.
FIG. 4 is a view, similar to FIG. 1, showing the swash plate in a reversed position as compared to FIG. 1.
FIG. 4A is a view, similar to FIG. 1A, indicating the direction of rotation of the cylinder block for illustrative purposes in connection with FIGS. 5 and 6.
FIG. 5 is a sectional view, similar to FIG. 2, illustrating the structural relation under the conditions shown in FIGS. 4 and 4A.
FIG. 6 is a sectional view, similar to FIG. 3, showing the structural relation between the parts under the conditions shown in FIGS. 4 and 4A.
FIG. 7 is a view, similar to FIG. 1, showing the position of the swash plate for an oppositely rotated pump and for illustrative purposes in connection with FIGS. 8 and 9.
Figure 10:
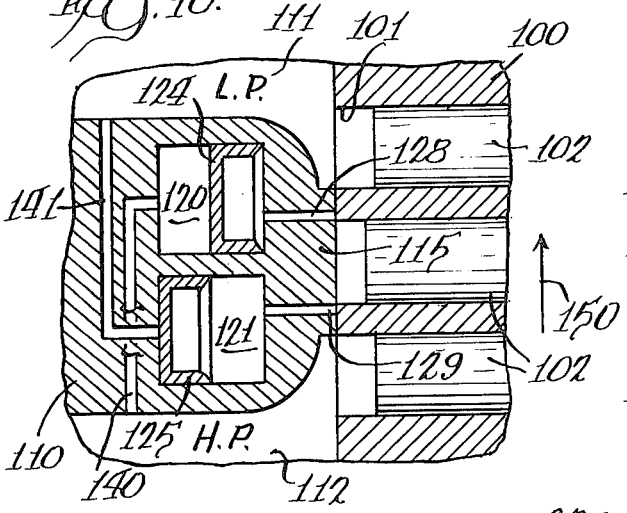
Figure 11:
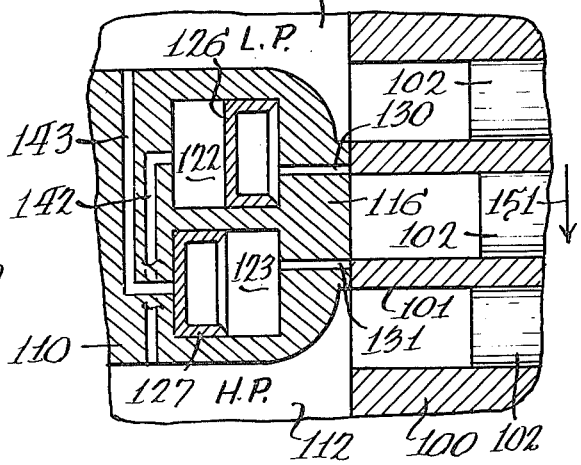
Figure 12A:
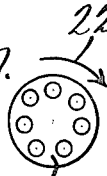
Figure 12:
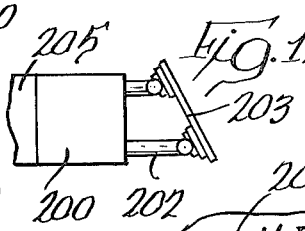
Figure 13:
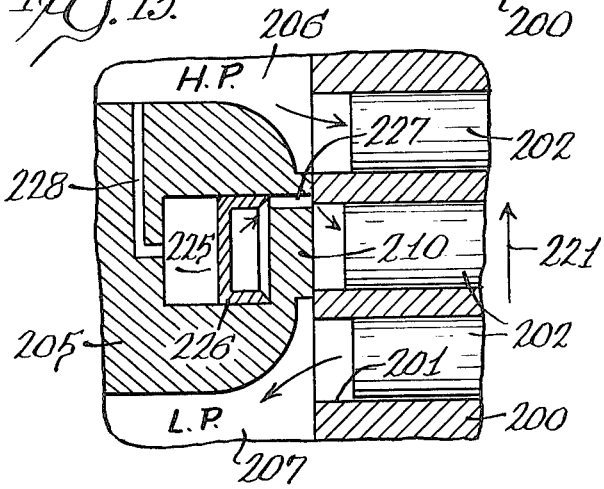
Figure 14:
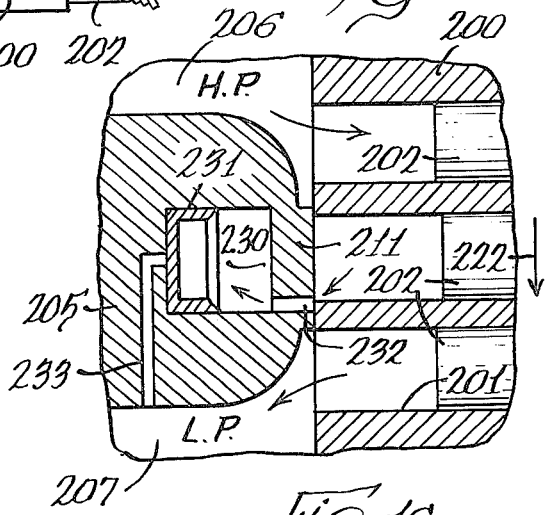
Figure 15:
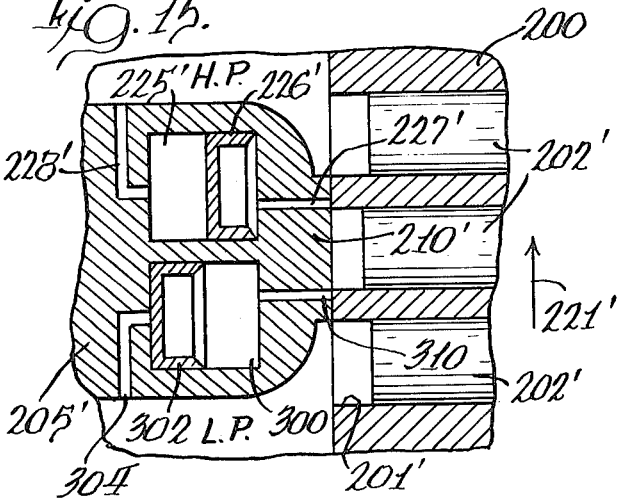
Figure 16:
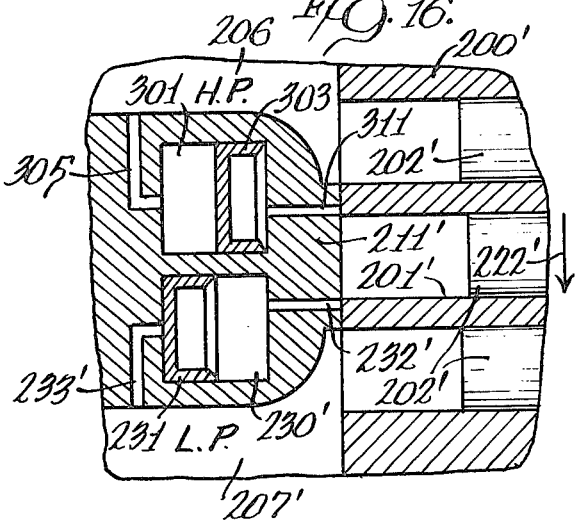

FIG. *7a* is a view, similar to FIG. 1A, indicating a direction of rotation of the cylinder block for illustrative purposes in connection with FIGS. 8 and 9;

FIG. 8 is a sectional view, similar to FIG. 2, showing the structural relation of the parts under the conditions shown in FIGS. 7 and 7A;

FIG. 9 is a sectional view, similar to FIG. 3, showing the structural relation of the parts under the conditions illustrated in FIGS. 7 and 7A;

FIG. 10 is a sectional view, similar to FIG. 2, of an alternate embodiment of an axial piston-type pump capable of operation in either direction of rotation of the cylinder block;

FIG. 11 is a sectional view, similar to FIG. 3, of the bi-directional modification of FIG. 10;

FIG. 12 is a view, similar to FIG. 1, of a modification of the device operable as a motor;

FIG. 12A is a view, similar to FIG. 1A, showing the direction of rotation of the cylinder block of FIG. 12 for illustrative purposes in connection with FIGS. 13 and 14;

FIG. 13 is a sectional view, similar to FIG. 2, of the embodiment of FIG. 12;

FIG. 14 is a sectional view, similar to FIG. 3, of the embodiment of FIG. 12;

FIG. 15 is a sectional view, similar to FIG. 13, of an embodiment of motor operable in both directions of rotation of the cylinder block; and FIG. 16 is a view, similar to FIG. 14, of the bidirectional embodiment of the motor.

DESCRIPTION OF THE PREFERRED EMBODIMENTS

A first embodiment of the rotary fluid energy translating device operable as an axial piston-type pump is shown in FIGS. 1 to 3 and with the capability of the embodiment to operate with a reversibly-angled swash plate being illustrated in FIGS. 4 to 6.

An axial piston-type pump is well known in the art and has a rotatable cylinder block 10 provided with a plurality of axially-extending cylinders 11, each of which movably mounts a linearly movable piston 12 with the pistons being stroked axially of the cylinders during rotation of the cylinder block by a swash plate 15. Also as well known in an axial piston-type pump, a valve plate 20 is disposed adjacent an end of the cylinder block and is provided with inlet and outlet port means 21 and 22 for sequentially communicating with the cylinders 11 during rotation of the cylinder block for controlling flow to and from the cylinders. The valve plate 20 has a pair of cross-over areas separating the port means 21 and 22 with an upper cross-over area 25 being shown in FIG. 2 and a lower cross-over area 26 being shown in FIG. 3. The cross-over areas are each of an arcuate length greater than the diameter of a cylinder 11 of the cylinder block to avoid cross-connection between the port means by a cylinder at the cross-over area.

With the direction of rotation of the cylinder block 10, as indicated by the arrows 30, 31, and 32, in FIGS. 1A, 2 and 3, respectively, and with the swash plate 15 angled as shown in FIG. 1, it will be noted in FIG. 2 that the pistons 12 are in an extended position providing a relatively small fluid volume within the sections of the cylinders 11 that communicate with the port means. The intermediate piston 12, shown in FIG. 2, is almost fully extended and will move toward the left a slight additional distance as it approaches top dead center which is slightly beyond the position illustrated in FIG. 2.

At the position shown in FIG. 3, the intermediate piston 12 is almost at fully-retracted position, since it is almost at bottom dead center, and with the adjacent pistons 12 being in a slightly advanced position beyond the intermediate piston 12.

In the pumping operation of FIGS. 1 to 3, the port means 21 constitutes the fluid outlet with a fluid pressure at a relatively high pressure, as indicated by "H.P." and the port means 22 constitutes an inlet port, with the fluid being at a relatively low pressure, as indicated by the legend "L.P." and with similar legends being used throughout the illustrations of the different embodiments of the inventions to indicate the pressure conditions in the ports during operation.

Referring to the three cylinders 11 shown in FIG. 2, the lowermost cylinder is in full communication with the outlet port 21, the intermediate cylinder 11 is out of communication with either of the port means by being opposite the cross-over area 25, and the uppermost cylinder 11 is in communication with the inlet port 22. Intermediate cylinder 11 has just left communication with the outlet port 21 and is positioned to communicate with a trapped fluid chamber 40 having a cup-shaped chamber piston 41 movable therein and a flow passage 42 sized to constitute an orifice extending between the trapped fluid chamber 40 and the face of the valve plate to communicate the chamber with a cylinder 11. Because of the location of the flow passage 42, trapped fluid chamber 40 never communicates with the fluid communicating with the outlet port 21 whereby he trapped fluid chamber fluid pressure is never at the outlet pump pressure. Chamber 40 does communicate not only with a cylinder 11, but also with the inlet port 22 as the cylinder block 10 rotates further in the direction indicated by the arrow 31 in FIG. 2 whereby the trapped fluid chamber can have its fluid approach the pressure of the fluid in inlet 22. The volume of the trapped fluid chamber is relatively small, as shown in FIG. 2, and is primarily defined by the interior of the cup-shaped piston 41 whereby the trapped fluid volume is relatively small and in relation to a relatively small volume of the fluid in the cylinders 11 because of the extension of the pistons 12 resulting from the position of the swash plate 15. With the relation described above, a cylinder 11, leaving the outlet port 21, closes off communication therewith and then has the leading edge of the cylinder communicate with the flow passage 42 whereby the high pressure existing in the cylinder end section is reduced to an intermediate pressure by flow indicated by an arrow 43 to provide a pressure transition before the cylinder 11 opens to the inlet port 22. This intermediate pressure exists not only in the end section of the cylinder 11 but also in the small volume chamber 40 and as the cylinder block 10 rotates further, the cylinder 11 connects the trapped fluid chamber to the inlet port 22 whereby the pressure within the trapped fluid chamber may reduce further prior to communicating with the next cylinder.

The position of the piston 41 is controlled by a pressure difference with the controlling means including a pilot line 50 in the valve plate 20 which interconnects the outlet port 21 with an end of the trapped fluid chamber 40 to exert outlet pressure on the piston 41 and with this pressure being opposed by a lesser pressure which always exists in the flow passage 42 and within the interior of the cup-shaped piston 31.

Referring to FIG. 3, the cylinder block 10, as viewed therein, is rotating in the direction of the arrow 32 whereby successive cylinders 11 leave the inlet port 22, are blocked in the cross-over area 26, and then open to the outlet port 21. During these successive movements, a piston 12 moves to fully-retracted position and then starts toward extended position in the pumping action of the pump. A trapped fluid chamber 60 is formed within the valve plate 20 and has a movable chamber piston 61 and an orifice-sized flow passage 62 extending to the face of the valve plate for communicating the chamber with the cylinder. Similarly to the piston 41, the position of the piston 61 is controlled by a pressure difference provided by a pilot line 63 in the valve plate which connects the inlet port 22 to an end of the chamber 60 to subject a face of the piston to the pressure existing at the inlet port while the cup-shaped interior of the piston 61 is subjected to a relatively high pressure in the cylinders 11. This positions the piston 61, as shown in FIG. 3, to provide a relatively large trapped fluid chamber. When the cylinder block 10 rotates slightly beyond the position shown in FIG. 3, the trapped fluid chamber 60 is in communication with the high pressure outlet port 21 whereby the pressure of the trapped fluid chamber may increase. When a cylinder 11 is in the intermediate position shown in FIG. 3, there is some flow from the trapped fluid chamber 60 into the cylinder 11 through the flow passage 62 to raise the pressure in the cylinder above the previously-existing pressure as derived from the cylinder having communicated with the inlet port 22, with the flow indicated by an arrow 65.

With the structure of the pump as now described, it will be seen that the pressure in a cylinder is either raised or lowered to an intermediate level by communication to a closed volume which is at the pressure toward which the cylinder 11 is travelling and with the trapped fluid chamber having a volume related to the size of the cylinder end section which is carrying the fluid around with the cylinder block. Reference has been made to the maximum extended and retracted positions of the pistons 12 and it will be noted that variations in the angle of inclination of the swash plate 15 will result in different positions of maximum extension and retraction of the pistons 12.

FIGS. 4 to 6 represent the same embodiment of pump as described in FIGS. 1 to 3 and illustrate the operation of the same pump structure with a reversed angle of the swash plate 15 to provide a reverse delivery from the pump. It will be noted that the rotation of the cylinder block is the same as identified by the same arrows 30, 31 and 32.

Because of the reversed inclination of the swash plate 15, the relation of the port means is reversed, with the port 22 being the outlet port and the port 21 being the inlet port and with the pressures being identified by the legends previously described. An additional difference in operation is in the position of the pistons 12 at the cross-over areas. At the top cross-over area 25, the intermediate piston 12 is at approximately fully-retracted position, while at the bottom cross-over area 26, the intermediate piston 12 is at approximately fully-extended position. This has resulted in the larger cylinder volumes being at the top cross-over area 25, with the result that the cup-shaped piston 41 is in a retracted position to provide a relatively large volume trapped fluid chamber 40. This results from the pilot line 50 extending to the low pressure port and there being a higher pressure existing in flow passage 42 which intermittently connects with the high pressure port 22.

At the lower cross-over area 26, the cup-shaped piston 61 is in a position to provide a small volume trapped fluid chamber, since high pressure is applied to the pilot line 63 to one face of the piston and there is a lower pressure acting oppositely against the piston because of the flow passage 62 being communicable with the low pressure port 21 for a certain interval of rotation of the cylinder block 10. The flow relation between the inlet and outlet port means and relative to the trapped fluid chambers is indicated by arrows in FIGS. 5 and 6.

FIGS. 7 to 9 show an alternate embodiment of an axial piston pump which is constructed for rotation of the cylinder block in a direction opposite to the rotation of the embodiment of FIGS. 1 to 6. This embodiment is given the same reference numerals as the embodiment of FIGS. 1 to 6, with a prime affixed thereto.

The cylinder block 10' rotates in the direction of an arrow 30' and, with the swash plate 15' positioned as shown in FIG. 7, the pistons 12' are in a generally extended position, as shown in FIG. 8, and a generally retracted position, as shown in FIG. 9, and with the rotation of the cylinder block being indicated by the arrows 31' and 32' in FIGS. 8 and 9, respectively.

In this embodiment, the trapped fluid chamber 40' is at a pressure less than the pumped fluid pressure in the outlet port 22' and, thus, functions to reduce the pressure in a cylinder 11' before the cylinder opens to the inlet port 21'. As shown in FIG. 8, the cylinder volume is relatively small and, thus, the trapped fluid chamber is relatively small because of the positioning of the piston 41' in response to the pumped pressure applied through the pilot line 50'. In FIG. 9, the trapped fluid chamber 60' is relatively large because pilot line 63' extends to the inlet port 21' and the piston 61' is in retracted position. The chamber 60' is at a value higher than the inlet pressure, whereby the pressure in a cylinder 11' approaching the outlet port 22' reaches an intermediate value prior to opening to the outlet port and with the large volume trapped volume chamber coacting with the relatively large volume portions of the cylinders 11'. As with the first embodiment, it will be noted that pressure within the cylinders is raised or lowered to an intermediate level by communication to a closed volume which is at the pressure towards which the cylinder is travelling and with the cylinder volumes being related to the trapped fluid chamber volumes.

Although not illustrated in the drawings, the structure of FIGS. 7 to 9 will also operate properly if the swash plate 15' is moved to an opposite position beyond neutral, with the reverse action being similar to that described with respect to reverse action of the first embodiment in FIGS. 4 to 6.

A third embodiment is shown in FIGS. 10 and 11 which relates to an axial piston-type unit providing for noise attenuation and which is a combination of the embodiments of FIGS. 1 to 6 and 7 to 9 to provide for a proper operation in both directions of rotation of the cylinder block and for reversal in inclination of the swash plate. In this embodiment, a cylinder block 100 has a series of cylinders 101 with each having a linearly movable piston 102 and with the cylinder block being associated with a valve plate 110 having a port means including a port 111 and a port 112 separated by an upper cross-over area 115 and a lower cross-over area 116. Each cross-over area has a pair of trapped fluid chambers with the cross-over area 115 having chambers 120 and 121 and the lower cross-over area 116 having chambers 122 and 123. Each of the chambers has a movable cup-shaped piston 124–127, respectively, which is positionable to determined the size of the chamber and with each chamber having a restricted flow passage extending into communicating relation with a cylinder. These flow passages are identified at 128–131. Additionally, a pilot line extends to each trapped fluid chamber, with a pilot line 140 extending between the port 112 and an end of the chamber 120. A pilot line 141 extends between the port 111 and an end of the chamber 121. A pilot line 142 extends between the port 112 and the chamber 122, with a pilot line 143 extending between the port 111 and an end of the chamber 123. With the direction of movement of the cylinder block being indicated by the arrows 150 and 151, it will be noted that a cylinder 101 travelling toward the low pressure inlet port 111 in FIG. 10 has a relatively small volume and coacts through the flow passage 128 with the small volume trapped fluid chamber 120 resulting from the positioning of the piston 124. Similarly, as shown in FIG. 11, a cylinder 101 travelling toward the high pressure port 112 coacts with the trapped fluid chamber 123 which is of a relatively large volume, similar to the relatively large volume of the cylinder 101 to provide the pressure transition previously described. In the event the angle of the swash plate is varied to an angle such as shown in FIG. 4, then the operation with respect to trapped fluid chambers 120 and 123 would be similar to that described in FIGS. 4 to 6. If the rotation of the cylinder block is reversed from the directions indicated by the arrows 150 and 151, then the trapped fluid chamber 121 would come into operation, as would the trapped fluid chamber 122 and with the pressures in the port means 111 and 112 controlling the positions of the movable pistons in the trapped fluid chambers, depending upon the direction of rotation and which port is at pump pressure and which is at inlet pressure to have the trapped chamber volumes generally correspond to the volumes of the cylinders.

In the embodiment of FIGS. 10 and 11, the respective pairs of flow passages 128, 129 and 130, 131 are spaced apart a sufficient distance to avoid cross-connection by a cylinder 101. With chambers 120 and 123 being active, the other two chambers 121 and 122 are relatively inactive, since the fluid in these chambers is generally at the same pressure as the fluid in the communicating cylinder 101. With a reversal of cylinder block rotation, the chambers 121 and 122 are active and the chambers 120 and 123 are inactive.

FIGS. 12 to 14 disclose an embodiment of the axial piston unit operable as a motor with a cylinder block 200 having cylinders 201, each of which movably mounts a linearly movable piston 202 with the stroke thereof being controlled by a swash plate 203. A valve plate 205 coacts with the cylinder block and has port means including a port 206 and a port 207 which are separated by cross-over areas including an upper cross-over area 210 and a lower cross-over area 211. With the movement of the cylinder block 200 being indicated by arrows 220, 221 and 222 and with the swash plate positioned as shown in FIG. 12, the cylinders 201, seen in FIG. 13, are travelling toward the motor inlet port 206, which is at high pressure, with the pistons 202 substantially extended and with a cylinder in the dead center area entering into communication with the trapped fluid chamber 225 having a movable cup-shaped piston 226 and a restricted flow passage 227. A pilot line 228 extends between the high pressure port 206 and the chamber 225 to position the chamber piston 226 as shown in FIG. 13 to have a relatively small volume trapped fluid chamber to coact with the relatively small volume portion of a cylinder. Thus, a cylinder approaching inlet port 206 will have the fluid carried therein raised to an intermediate pressure prior to communicating with the inlet port 206. At the cross-over area 211, as shown in FIG. 14, a trapped fluid chamber 230 has a movable piston 231 and an orifice-type flow passage 232 extending to the cylinder block. A pilot line 233 extends between the outlet port 207 of the motor which is at low pressure and to the chamber 230 whereby the piston 231 is in a position to have the chamber 230 of maximum size and correspond to the situation within the adjacent cylinders 201 where the pistons 202 are in retracted position. Thus, as a cylinder 201 approaches the low pressure outlet port 207, the pressure existing therein is reduced by communication with the trapped fluid chamber 230.

Although not illustrated, it will be evident that the teachings disclosed herein may be utilized to provide a structure for a motor which is to be rotated in a direction opposite to that in the embodiment of FIGS. 12–14. In a motor, the pilot line which extends to a trapped fluid chamber, extends to the port toward which a cylinder 201 is travelling and, thus, a motor which is to rotate in a direction opposite from that shown in FIGS. 12 to 14 would have the pilot lines and flow passages reversed so that the pilot lines would extend to the ports which the cylinders are approaching and the flow passages leading to the trapped fluid chambers would be immediately adjacent the port to which the cylinders are travelling. This structure is made evident in the disclosure of the embodiment of FIGS. 15 and 16 which discloses a motor capable of bi-directional rotation. Those parts which are common to the embodiment of FIGS. 12 to 14 are given the same reference numeral with a prime affixed thereto.

With the direction of rotation as indicated by the arrows 221′ and 222′, it will be evident that trapped fluid chambers 225′ and 230′ operate in the same manner as the corresponding structure in the embodiment of FIGS. 12 and 14. In order to handle the direction of movement opposite to that indicated by the arrows 221′ and 222′, each cross-over area has an additional trapped fluid chamber with the chamber 300 being provided in valve plate 205′ at the upper cross-over area and chamber 301 at the lower cross-over area. The chambers have the respective cup-shaped pistons 302 and 303, with each being positioned under the control of a pilot line 304 and 305, respectively. The chamber 300 has an orifice type flow passage 310 for connecting a cylinder with the chamber 300 and a restricted orifice-type flow passage 311 connects a cylinder to the fluid chamber 301. With this structure, a trapped fluid chamber is operable to bring the fluid pressure within a cylinder to an intermediate level approaching that of the port towards which the cylinder is travelling and with the chamber piston being positioned to relate the volume of the trapped fluid chamber to the volume of fluid in a cylinder by having the pistons piloted from the port toward which the cylinder is travelling.

In the embodiment of FIGS. 15 and 16, the respective pairs of flow passages 227′, 310 and 232′,311 are spaced apart a sufficient distance to avoid cross-connection by a cylinder 201′. With two chambers being active, the other two chambers are inactive similarly to the embodiment of FIGS. 10 and 11.

I claim:

1. A rotary fluid energy translating device comprising, a rotatable cylinder block having a plurality of cylinders therein, valve means having inlet and outlet port means adapted to serially connect with the cylinders and a pair of cross-over areas positioned to block a cylinder from simultaneous communication with the inlet and outlet port means, each of said cylinders having a movable member with the members of the cylinders adjacent one cross-over area positioned to provide small fluid volume in the associated cylinders and the members of the cylinders adjacent the other cross-over area positioned to provide large fluid volume in the associated cylinders, a trapped fluid chamber in each of said cross-over areas having a flow passage positioned to communicate with a cylinder prior to a cylinder communicating with one of the port means in order to reduce the rate of pressure change when a cylinder subsequently communicates with one of said port means, movable means in each chamber to vary the volume of said chamber, and means for controlling said movable means to have a small volume chamber when an adjacent cylinder has a small fluid volume and to have a large volume chamber when an adjacent cylinder has a large fluid volume.

2. A rotary fluid energy translating device as defined in claim 1 wherein said controlling means includes a pair of pilot lines extended one between each of said port means and a movable means to apply the fluid pressure existing in the port means to the associated movable means and establish the volume of the trapped fluid chambers.

3. A rotary fluid energy translating device as defined in claim 2 wherein said device is a pump and the movable means which is positioned to establish a small volume chamber has the associated pilot line connected to said outlet port means.

4. A rotary fluid energy translating device as defined in claim 2 wherein said device is a pump and the movable means which is positioned to establish a large volume chamber has the associated pilot line connected to said inlet port means.

5. A rotary fluid energy translating device as defined in claim 2 wherein said device is a pump with the movable means which is positioned to establish a small volume chamber having the associated pilot line connected to said outlet port means, and the movable means which is positioned to establish a large volume chamber having the associated pilot line connected to said inlet port means.

6. A rotary fluid energy translating device as defined in claim 2 wherein said device is variable displacement swash plate type pump with the swash plate operable to reverse the delivery of the pump, and said pilot lines connected to the port means and the trapped fluid chambers in a relation to, in any position of the swashplate, have the same relation of small volume chamber to small volume cylinders and large volume chamber to large volume cylinders in all positions of the swash plate.

7. A rotary fluid energy translating device as defined in claim 6 wherein said pump cylinder block is operable in two opposite directions of rotation, and means providing the aforesaid volume relation between chambers and cylinders in both directions of rotation of the cylinder block.

8. A rotary fluid energy translating device as defined in claim 2 wherein said device is a motor and the movable means which is positioned to establish a small volume chamber has the associated pilot line connected to said inlet port means.

9. A rotary fluid energy translating device as defined in claim 2 wherein said device is a motor and the movable means which is positioned to establish a large volume chamber has the associated pilot line connected to said outlet port means.

10. A rotary fluid energy translating device as defined in claim 2 wherein said device is a motor, said movable means which is positioned to establish a small volume chamber has the associated pilot line connected to said inlet port means, and the movable means which is positioned to establish a large volume chamber has the associated pilot line connected to said outlet port means.

11. A rotary fluid energy translating device as defined in claim 2 wherein said device is a motor with the rotatable cylinder block operable in two opposite directions of rotation, and means providing the aforesaid volume relation between chamber and cylinder in both directions of rotation.

12. A rotary fluid energy translating device as defined in claim 2 wherein said rotatable cylinder block is alternately rotatable in two opposite directions of rotation, and each cross-over area has two of said trapped fluid chambers each with a separate flow passage for selective communication with a cylinder in advance of a cylinder communicating with one of the port means in either direction of rotation of the cylinder block.

13. An axial piston-type variable displacement pump including a rotatable cylinder block with a series of cylinders each having a reciprocal piston and a movable swash plate for controlling the stroke of the pistons and operable to reverse the delivery of the pump, a valve plate adjacent the cylinder block and having inlet and outlet port means for controlling flow of fluid to and from said cylinders and having a pair of cross-over areas separating adjacent ends of said port means, a pair of trapped fluid chambers associated one with each cross-over area and each having a flow passage extending into communication with a cylinder at said cross-over areas, the fluid volume of said cylinders adjacent the two cross-over areas differing with the pistons at one cross-over area being extended to provide small cylinder volume and the pistons at the other cross-over area being retracted to provide large cylinder volume, means for varying the size of said trapped fluid chambers, and means for controlling the size-varying means to have a relatively large fluid chamber coact with a cylinder of large fluid volume and a smaller fluid chamber coact with a cylinder of smaller fluid volume.

14. A pump as defined in claim 13 wherein each of said cross-over areas is of an arcuate length greater than the diameter of a cylinder to prevent a cylinder communicating simultaneously with both port means and with said flow passages positioned in said valve plate to each have an open end communicate with a cylinder after the cylinder has moved beyond one of said port means and to have said open ends communicate with a cylinder prior to and during communication of the lastmentioned cylinder with the other port means.

15. A pump as defined in claim 14 wherein said trapped fluid chambers are formed in said valve plate, and said size-varying means includes a piston movable in a chamber.

16. A pump as defined in claim 15 wherein said controlling means includes a pair of fluid pilot lines in the valve plate extended one from each of said port means to a chamber for having the position of a piston responsive to the fluid pressure in one of the port means as opposed to the fluid pressure in a cylinder communicating with the associated flow passage.

17. A pump as defined in claim 16 wherein said valve plate has a pair of trapped fluid chambers each with a flow passage in each of said cross-over areas whereby a cylinder may communicate with a trapped fluid chamber prior to and during communication with one of the port means toward which the cylinder is travelling in either direction of rotation of said cylinder block.

18. A pump as defined in claim 17 wherein each of said trapped fluid chambers has the associated pilot line communicating with said one of the port means which the cylinder is travelling away from during rotation of the cylinder block.

19. An axial piston-type motor including a rotatable cylinder block with a series of cylinders each having a reciprocal piston and a swashplate for controlling the stroke of the pistons, a valve plate adjacent the cylinder block and having inlet and outlet port means for controlling flow of fluid to and from said cylinders and having a pair of crossover areas separating adjacent ends of said port means, a pair of trapped fluid chambers associated one with each crossover area and each having a flow passage extending into communication with a cylinder at said cross-over areas, the fluid volume of said cylinders adjacent the two cross-over areas differing with the pistons at one cross-over area being extended to provide small cylinder volume and the pistons at the other cross-over area being retracted to provide large cylinder volume, means for varying the size of said trapped fluid chambers, and means for controlling the size-varying means to have a relatively large fluid chamber coact with a cylinder of large fluid volume and a smaller fluid chamber coact with a cylinder of smaller fluid volume.

20. A motor as defined in claim 19 wherein each of said cross-over areas is of an arcuate length greater than the diameter of a cylinder to prevent a cylinder communicating simultaneously with both port means and with said flow passages positioned in said valve plate to each have an open end communicate with a cylinder after the cylinder has moved beyond one of said port means and to have said open ends communicate with a cylinder prior to and during communication of the lastmentioned cylinder with the other port means.

21. A motor as defined in claim 20 wherein said trapped fluid chambers are formed in said valve plate, and said size-varying means includes a piston movable in a chamber.

22. A motor as defined in claim 21 wherein said controlling means includes a pair of fluid pilot lines in the valve plate extended one from each of said port means to a chamber for having the position of a piston responsive to the fluid pressure in the port means as opposed to the fluid pressure in a cylinder communicating with the associated flow passage.

23. A motor as defined in claim 22 wherein said valve plate has a pair of trapped fluid chambers each witha flow passage in each of said cross-over areas whereby a cylinder may communicate with a trapped fluid chamber prior to and during communication with one of the port means toward which the cylinder is travelling in either direction of rotation of said cylinder block.

24. A motor as defined in claim 23 wherein each of said trapped fluid chambers has the associated pilot line communicating with the port means toward which the cylinder is travelling during rotation of the cylinder block.

25. An axial piston-type variable displacement pump including a rotatable cylinder block with a series of cylinders each having a reciprocal piston and a movable swashplate for controlling the stroke of the pistons and operable to reverse the delivery of the pump, a valve plate adjacent the cylinder block and having inlet and outlet port means for controlling flow of fluid to and from said cylinders and having a pair of cross-over areas separating adjacent ends of said port means and an arcuate length greater than the diameter of a cylinder to prevent a cylinder communicating simultaneously with both port means, a pair of trapped fluid chambers associated one with each cross-over area and each having a flow passage extending into communication with a cylinder at said cross-over areas, the fluid volume of said cylinders adjacent the two cross-over areas differing with the pistons at one cross-over area being extended to provide small cylinder volume and the pistons at the other cross-over area being retracted to provide large cylinder volume, means including a piston for varying the size of said trapped fluid chambers, and means for controlling the size-varying means to have a relatively large fluid chamber coact with a cylinder of large fluid volume and a smaller fluid chamber coact with a cylinder of smaller fluid volume including a pair of fluid pilot lines in the valve plate extended one from each of said port means to a chamber for having the position of a piston responsive to the fluid pressure in one of the port means as opposed to the fluid pressure in a cylinder communicating with the associated flow passage each of said trapped fluid chambers having the associated pilot line communicating with said one of the port means which the cylinder is travelling away from during rotation of the cylinder block.

26. An axial piston-type motor including a reversibly rotatable cylinder block with a series of cylinders each having a reciprocal piston and a swash plate for controlling the stroke of the pistons, a valve plate adjacent the cylinder block and having inlet and outlet port means for controllingflow of fluid to and from said cylinders and having a pair of cross-over areas separating adjacent ends of said port means and of an arcuate length greater than the diameter of a cylinder to prevent a cylinder communicating simultaneously with both port means, a pair of trapped fluid chambers associated one with each cross-over area and each having a flow passage extending into communication with a cylinder at said crossover areas, the fluid volume of said cylinders adjacent the two cross-over areas differing with the pistons at one crossover area being extended to provide small cylinder volume and the pistons at the other cross-over area being retracted to provide large cylinder volume, means including a piston for varying the size of said trapped fluid chambers, and means for controlling the size-varying means to have a relatively large fluid chamber coact with a cylinder of large fluid volume and a smaller fluid chamber coact with a cylinder of smaller fluid volume including a pair of fluid pilot lines in the valve plate extended one from each of said port means to a chamber for having the position of a piston responsive to the fluid pressure in the port means as opposed to the fluid pressure in a cylinder communicating with the associated flow passage and each of said trapped fluid chambers having the associated pilot line communicating with the port means toward which the cylinder is travelling during rotation of the cylinder block.

* * * * *